US005359821A

United States Patent [19]

Merriman

[11] Patent Number: 5,359,821

[45] Date of Patent: Nov. 1, 1994

[54] SUPPORT SYSTEM FOR MOBIL AND MANUFACTURED HOUSING

[76] Inventor: Denys J. Merriman, 13359 Rimview Ct., Yucaipa, Calif. 92399

[21] Appl. No.: 934,796

[22] Filed: Aug. 24, 1992

[51] Int. Cl.[5] ..... E02D 27/48

[52] U.S. Cl. ..... 52/169.9; 52/299; 52/126.6

[58] Field of Search ..... 52/DIG. 11, 299, 169.9, 52/126.6

[56] References Cited

U.S. PATENT DOCUMENTS

| | | | |
|---|---|---|---|
| 4,148,162 | 4/1979 | Goodrich | 52/23 |
| 4,417,426 | 11/1983 | Meng | 52/126.7 |
| 4,546,581 | 10/1985 | Gustafson | 52/169.9 |
| 4,562,673 | 1/1986 | Barari | 52/167 |
| 4,761,924 | 8/1988 | Gustafson | 52/126.6 |

OTHER PUBLICATIONS

"For 18 Years . . .", Brochure, Fall-Stop Corporation, 1989, 4 pgs.

"The Answer to Putting . . .", Brochure, Stabilizer Systems, Inc. 1985, 4 pgs.

*Primary Examiner*—Carl D. Friedman

*Assistant Examiner*—Beth A. Aubrey

*Attorney, Agent, or Firm*—Christie, Parker & Hale

[57] ABSTRACT

A bracing system, useable beneath the habitable structures of mobil homes and manufactured housing to render such structures secure from loss of support due to seismic events, includes a plurality of tubular braces which are connected to chassis beams of the structures and to foundation pads supported at grade at spaced locations below the beams. The braces include pairs of longitudinal beams of fixed length which are pinned at lower ends to the pads and slope in opposite directions upwardly below the adjacent beams to their upper ends. The braces include a telescoping transverse brace pinned at its lower end to a pad and connected to an adjacent beam at its upper end. Each transverse brace is continuously adjustable in length through a selected range of lengths prior to connection between a pad and a laterally adjacent beam, and is fixed at its as-installed length by a pin secured in holes drilled after installation through the concentrically overlapping tubes. A drill adapted for use in height-limited spaces below such structures to drill bolting holes in the chassis beams is also disclosed.

15 Claims, 11 Drawing Sheets

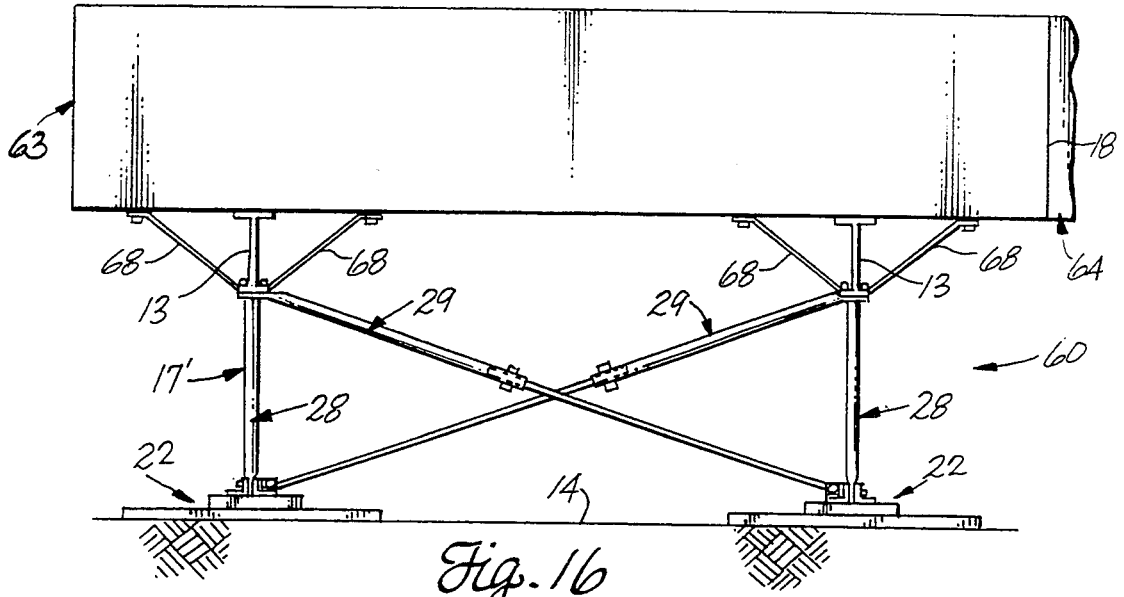
Fig. 16
Fig. 17
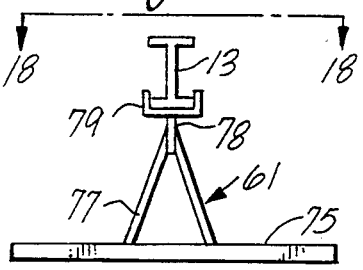
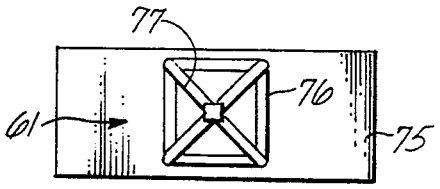
Fig. 18
Fig. 19
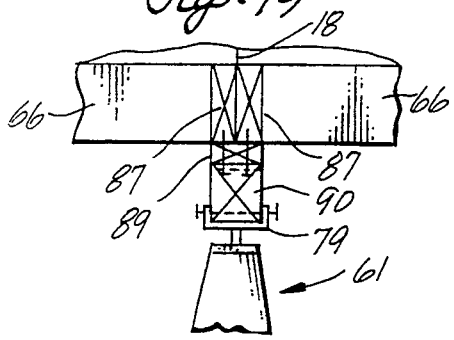
Fig. 20
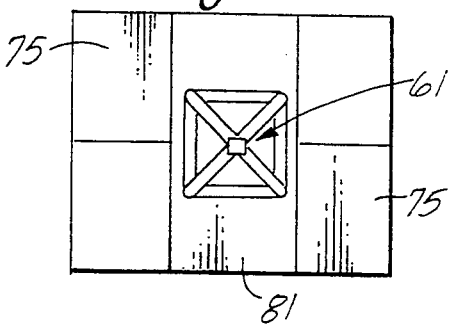

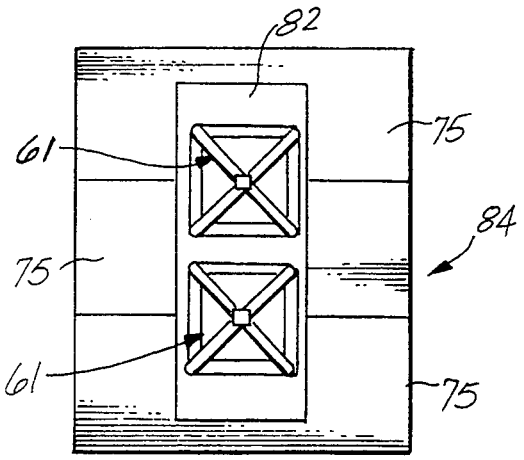
Fig. 21
Fig. 23
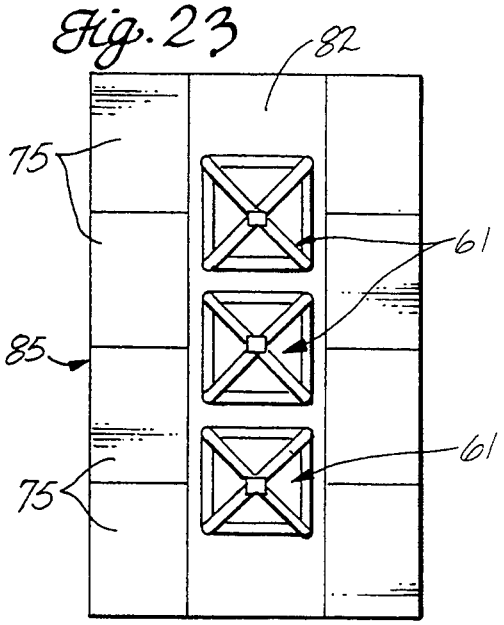
Fig. 22
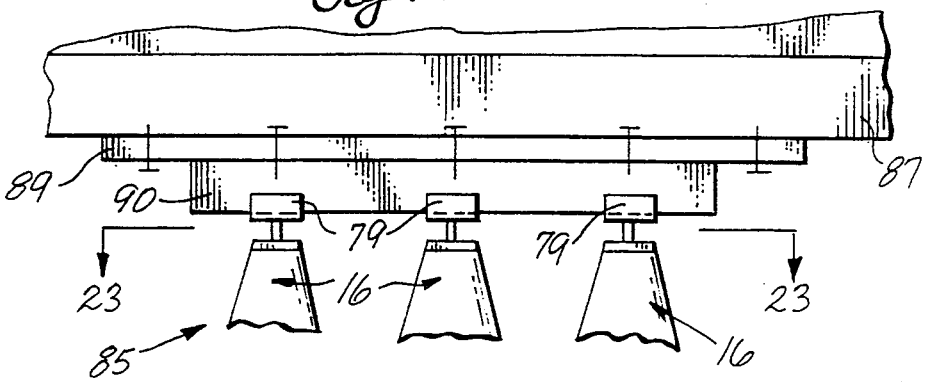
Fig. 24
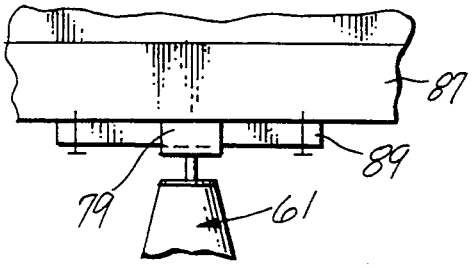

SUPPORT SYSTEM FOR MOBIL AND MANUFACTURED HOUSING

FIELD OF THE INVENTION

This invention concerns the structural and procedural aspects of a system for bracing mobil and manufactured housing against loss of support due to earthquakes and other events which otherwise could cause such housing structures to fall off their supporting piers. More particularly, it concerns such aspects of a bracing system which is readily and effectively installable and which accommodates and conforms to the dimensions and geometries of individual usage contexts.

BACKGROUND OF THE INVENTION

The Context of the Invention. Due to the increasing costs of conventional single-family housing, a steadily increasing portion of families in the United States, as well as in other countries, reside in mobil and in manufactured housing structures. Such structures are manufactured in compliance with applicable standards and include a chassis for each housing unit; plural units can be used together in a mated relation to form a single habitable structure. Each unit has a rectangular floor plan, and each unit chassis includes a pair of longitudinal beams which are parallel to each other within the width of the chassis. The units are moved on wheels from their places of manufacture to their sites of use where the wheels often are removed after the units have been supported on independent spaced vertical piers. The piers are installed at the unit usage site, which is substantially permanent, between the chassis beams and the natural or prepared grade surface at the site.

The piers on which mobil and manufactured housing units are supported at their usage sites are effective to provide the requisite vertical support for the housing units. However, earthquakes or other natural events, such as abnormally high winds, can impose lateral load on the pier-supported units of sufficient magnitude to cause the housing units to move off of their supporting piers. Such occurrences present the context of the problem to which this invention is addressed.

REVIEW OF THE PRIOR ART

The coastal and other regions of Southern California, and also other places, are recognized as areas where earthquakes, though occurring at unpredictable times, are common. Earthquakes of even modest magnitude can produce ground movements sufficient to cause manufactured housing units to move off their supporting piers, thereby significantly damaging the housing units and rendering them unsuitable, sometimes permanently, for use. As a consequence, an industry has developed to provide supplemental bracing systems which are installable under pier-supported manufactured housing units to provide a unit support arrangement which significantly improves the ability of the unit to remain properly supported above the ground during an earthquake. Such bracing systems also are useful in other places to enable manufactured housing units to remain properly supported when subjected to high wind loads which can be encountered in tornadoes and in hurricanes.

One existing earthquake bracing system for manufactured housing and the like is that manufactured by Stabilizer Systems, Inc., of San Bernardino, Calif., and to which U.S. Pat. Nos. 4,261,149, 4,546,581, 4,761,924, 4,914,875 are pertinent. As manufactured, that bracing system replaces the conventional prefabricated pier supports for a housing unit. That system replaces the conventional pier with tubular steel vertical supports which are clamped to the flanges of I beams used to define the unit chassis beams. That system is not readily usable to support housing units which include chassis beams of hot "C" (channel) or cold "C" (channel with lips parallel to the web at the ends of the channel flanges) configuration; approximately twenty percent of existing manufactured housing units include chassis beams of hot "C" or cold "C" transverse profile. Also, that system is substantially of the made-to-measure kind in which the longitudinal and transverse braces of channel profile are tailored in length at the factory to suit the dimensions of each individual usage situation as measured at each usage site. A consequence of that characteristic of the system is that more or less time must elapse between the making of a decision to install a system and the installation of the system. Off-site customization of the system components to specific usage dimensions causes that system to be relatively costly. Also, the longitudinal and transverse brace components of that system are clamped to the chassis I beam flanges rather than connected directly to the beams.

A supplemental earthquake resistant bracing system for manufactured housing units is commercially manufactured by Fail-Stop Corp. of Huntington Beach, Calif. That bracing system is installable in parallel with, not as a replacement for, the conventional pier supports for manufactured housing units. While its longitudinal and transverse brace components are connectible directly to unit chassis beams, those braces (notably the transverse braces) are made-to-measure to suit the dimensions of each individual usage situation. Thus, that system is also relatively costly and delays are common between the times of decision to install and of installation.

A need exists for a supplemental, earthquake resistant bracing system for manufactured housing support arrangements which uses standard components which are readily adapted at a usage site to suit and conform to the particular dimensions encountered at a particular usage site. The components of such a bracing system can be maintained economically in inventory by a licensed installation contractor who can respond promptly and effectively to install the system soon after a decision to install has been made.

SUMMARY OF THE INVENTION

The present invention addresses the need identified above by providing an improved earthquake resistant bracing system for use with manufactured housing and mobil homes. The system provides effective and efficient support and bracing arrangements which use standard components which are effectively subject to adjustments thereof in the field, rather than at a remote place of manufacture, thereby to service a wide range of usage situations and to accommodate a wide range of particular installation geometries and dimensions. The components of the system can be maintained economically in inventory by a licensed installation contractor. Provided the contractor has an adequate inventory of bracing system components, the contractor can respond promptly and efficiently to install the bracing system promptly after a decision to install such a system has been made. Further, the structural aspects of the bracing system are consistent with improved procedures which enable the bracing system to be installed rapidly and effectively as an installation site. Such efficiencies make possible a substantial reduction in the cost of earthquake bracings for manufactured housing and the like. The invention also provides an effective attachment device for a power drill which enables bolting holes for bracing system components to be drilled readily and efficiently in the longitudinal structural beams forming components of the chassis of a manufactured housing unit, in situations where the persons installing the bracing system must work in height-limited spaces.

Generally speaking, in terms of structure, this invention provides an earthquake resistant bracing system for mobil homes and manufactured housing units. Such units include a chassis comprised of a pair of spaced parallel, longitudinal metal structural beams. The bracing system includes, for each housing unit, at least a pair of foundation pads which are adapted for placement at grade at spaced locations along and below each unit chassis unit beam, so that a least a pair of foundation pads are associated with each chassis beam. Also, in combination with each foundation pad, the bracing system includes a pair of tubular longitudinal braces and a tubular transverse brace assembly. The longitudinal braces are of predetermined length and are adapted to be pinned to the foundation pad at lower ends of the braces and to diverge upwardly in a first vertical plane in opposite directions to upper ends of those braces which are adapted for bolted connections to a corresponding unit chassis beam. The transverse brace assembly is adapted to be pinned at a lower end thereof to the foundation pad and to extend in a second vertical plane, substantially normal to the first plane, to an upper end which is adapted to be bolted to the other chassis beam. Each transverse brace assembly comprises a relatively larger and a relatively smaller tubular member. The tubular members are telescopically engagable with each other, centrally of the ends of the assembly, and are securable from axial relative motion via a pinned connection to establish an "as installed" length of the transverse brace. Thus, each transverse brace is fixed in length after its opposite ends have been connected between a foundation pad and the opposite chassis beam of the housing unit with which the transverse brace is associated.

In terms of procedure, this invention provides a method for bracing a unit of manufactured housing against loss of support by earthquakes and other natural events, which housing unit includes a pair of spaced parallel longitudinal chassis beams. In typical practice of this method, the housing unit is supported above grade on a plurality of piers which are engaged with the chassis beams to define a crawl space between the unit and grade. The inventive method comprises a sequence of steps including the step of establishing a foundation pad, at grade at each of at least of a pair of spaced locations below and along each chassis beam. The method also includes the steps of pinning to each foundation pad at lower ends thereof, a pair of tubular longitudinal braces of predetermined length, and of bolting upper ends of the longitudinal braces to the corresponding chassis beam at locations spaced in opposite directions from the foundation pad. The method includes the further steps of pinning to each foundation pad the lower end of a two-part telescopically length-adjustable tubular transverse brace, and of bolting an upper end of each transverse brace to the other chassis beam at a location which is substantially opposite the lower end of that transverse brace. The method includes the further step of fixing each transverse brace against axial movement of its two parts relative to each other after connection of the brace lower and upper ends, respectively, to the foundation pad and to the other beam.

DESCRIPTION OF THE DRAWINGS

The above mentioned and other features and procedural steps of this invention are more fully set forth in the following description of a presently preferred embodiment of the structural and procedural aspects of the invention, as well as of other embodiments and aspects of the invention, which description is presented with reference to the accompanying drawings, wherein:

FIG. 2 shows that the housing structure is composed of a pair of mated manufactured housing units below each of which a bracing system according to this invention has been installed;

FIG. 16 is an elevation view taken along line 16—16 of FIG.14;

FIG. 17 is an elevation view, taken along line 17—17 of FIG. 14, of a vertical support pier in the support and bracing system shown in FIG. 14;

FIG. 18 is a plan view taken along line 18—18 of FIG. 17;

FIG. 19 is a fragmentary elevation view taken along line 19—19 of FIG. 14;

FIG. 20 is view, similar to FIG. 18, of a support pier having a higher load capacity than the pier shown in FIG. 17;

FIG. 21 is a plan view, similar to FIG. 20, showing a support pier assembly which has a higher load capacity than the pier shown in FIG. 20;

FIG. 22 is a fragmentary elevation view taken along line 22—22 in FIG. 14;

FIG. 23 is a plan view taken along line 23—23 of FIG. 22;

FIG. 24 is a fragmentary elevation view showing engagement of a support pier to the adjacent floor rims of mated housing units, which arrangement is an alternative to the arrangement shown in FIG. 22;

DESCRIPTION OF THE ILLUSTRATED EMBODIMENTS

Figure 1:
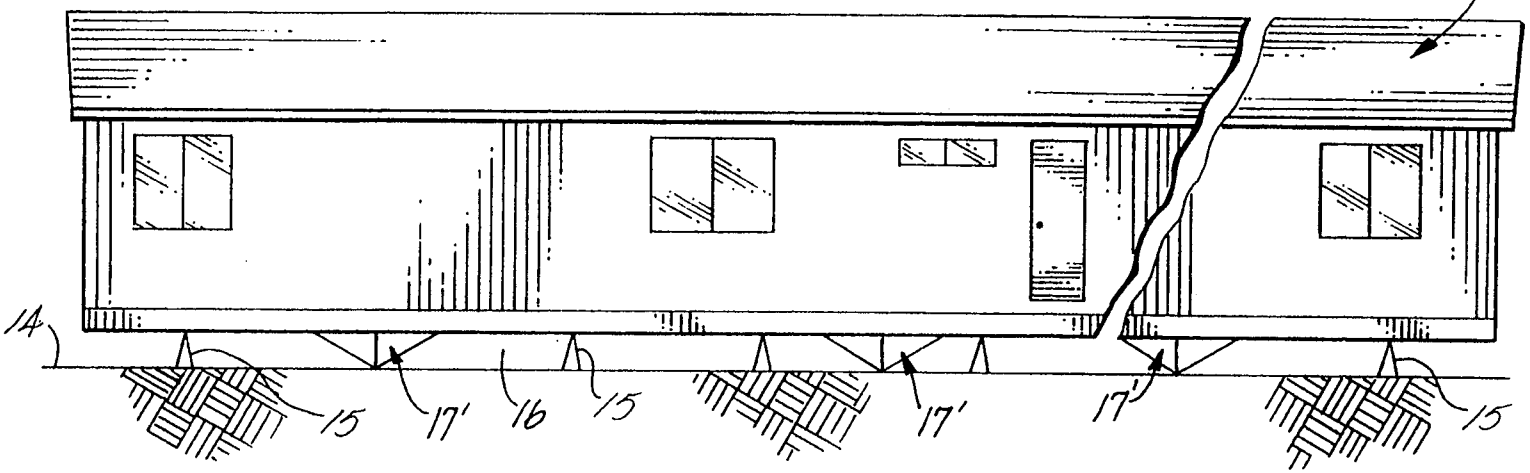
FIG. 1 is an elevation view of a manufactured housing structure supported on piers to define a crawl space within which is installed a bracing system according to this invention.
Figure 2:
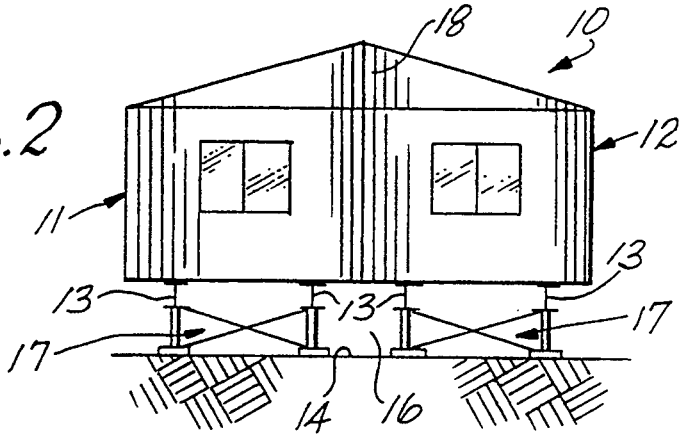
FIG. 2 is an end elevation view of the housing structure shown in FIG. 1.

FIGS. 1 and 2 are side and end elevation views of a habitable structure 10 useful as a single family dwelling, for example. As shown best in FIG. 2, structure 10 is composed of mated individual manufactured housing units 11 and 12. A two-unit manufactured housing structure is selected as the environment within which the present inventions are described. It will be appreciated, however, that the devices and procedures of this invention can be used to provide earthquake resistant bracing, and permanent foundation support and bracing, for manufactured housing structures composed of one, two, three, four or even more units suitably mated in a desired relation.

As shown in FIG. 2, each housing unit 11, 12 has a supporting chassis which includes, as principal components, a pair of structural beams 13 which are disposed parallel to each other at spaced locations across the width of the unit. The beams extend over the full length of the unit which can be as long as 66 feet in extent. Each housing unit is supported above an adjacent supporting surface 14, called "grade", on a plurality of piers 15 which are engaged between each chassis beam 13 and grade at suitably spaced locations along the beams. As so supported on the piers 15, each housing unit provides below it a crawl space 16 which has a height between grade the chassis beams which typically is in the range of from 20 to $27\frac{1}{2}$ inches, although crawl spaces of lower height are not uncommon.

The piers 15 which are used to support a conventionally installed manufactured housing structure are of conventional structure and are available with different load ratings. In general, piers 15, which constitute a portion of the environment within which this invention preferably is practiced, resemble square-base, open-framework, truncated pyramids carrying at their upper ends U-shaped brackets for straddling the opposite sides of the lower portion of a housing unit chassis beam. The beam engaging bracket of a conventional pier typically is vertically adjustable on the top of the pier framework. The vertical adjustment is provided by a threaded stud secured to the underside of the beam engaging bracket, the stud being axially adjustable in the top of the pier framework. The piers which are used to provide minimal legal support for manufactured housing units as typically installed by their manufacturers can be and preferably are used in the practice of this invention and are shown in FIGS. 17–24 pertinent to a second preferred embodiment of this invention.

In the typical, legally minimum installation of a manufactured housing structure, piers 15 are merely placed upon the grade surface, or upon simple pressure treated wood slabs positioned upon the grade surface. The piers are engaged in straddling relation with the lower portions of the chassis beams for the housing units. The piers are spaced about five feet apart, sometimes less, along the length of each chassis beam. Such piers provide adequate support of the vertical loads applied to them, but are notoriously weak in resisting loads applied to the supported structure which induce the structure to move laterally relative to the grade surface. Such loads can be applied to structure 10, for example, by an earthquake which causes the land beneath the structure to move laterally relative to the structure which tends to remain stationary. If a seismic event in the vicinity of a conventionally supported manufactured housing structure is of sufficient magnitude and of the right nature of motion, it is not uncommon for such structures to fall partially or completely from their supporting piers as a result of overturning of the piers. In such events, the habitable structures can suffer considerable damage, if not be totally destroyed. Also, conventionally supported manufactured housing structures can experience similar kinds of damage due to abnormally high lateral wind loads applied to them, such as in a tornado or a hurricane.

An earthquake resistant bracing system (ERBS) 17 according to this invention is installed in the crawl space 16 beneath each of housing units 11 and 12 between grade and chassis beams 13. ERBS system 17 secures the vertical supports for the housing units from overturning or collapse during earthquakes or other potentially damaging natural events.

Figure 3:
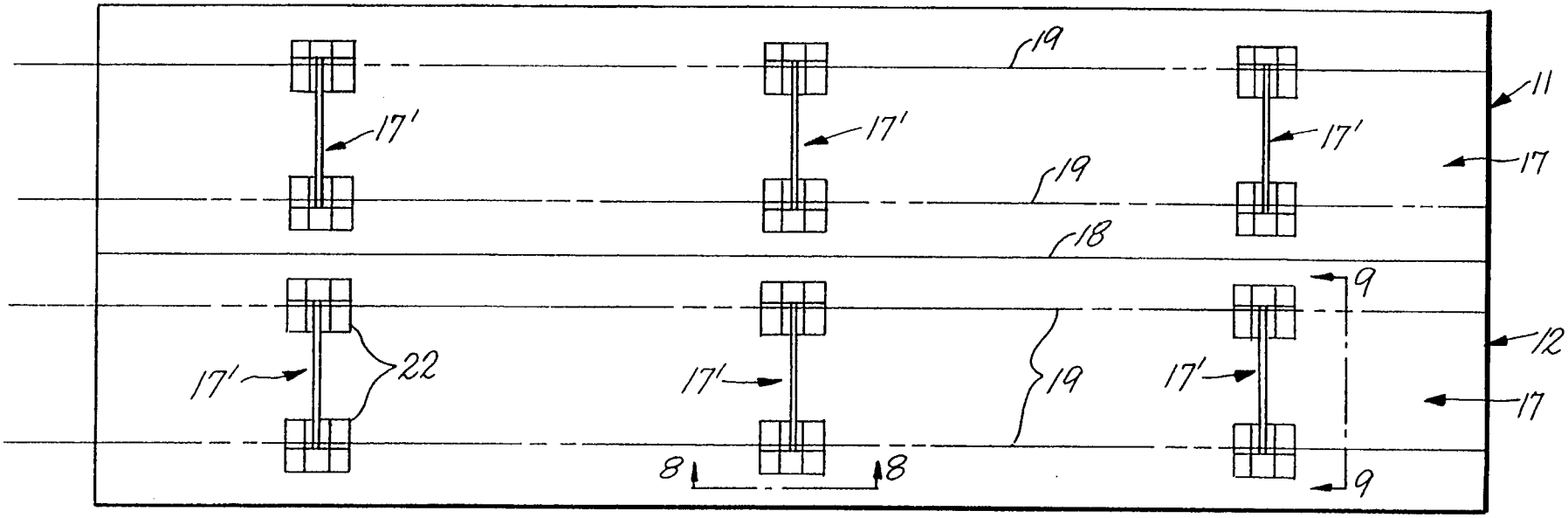
FIG. 3 is a simplified plan view showing the relation between the bracing systems and the housing units illustrated in FIG. 2.

FIG. 3 is a schematic plan view which shows the location of the components of ERBS systems 17 below housing units 11 and 12. The housing units are mated together along a mating line 18. In FIG. 3, lines 19 represent the center lines of the longitudinal chassis beams 13 of the respective housing units. In the exemplary situation shown in FIG. 3, three ERBS subsystems 17' are installed beneath each housing unit. A minimum of 3 ERBS subsystems are used when a housing unit has a length of 66 feet and less; a minimum of 2 ERBS subsystems are used where the housing unit has a length of 44 feet and less. FIG. 3 depicts the illustrative situation where each housing unit 11 and 12 has a length of 66 feet. Accordingly, the ERBS subsystems under each housing unit are spaced 23 feet apart (maximum) from each other along the length of the unit symmetrically relative to the midlength of the unit. The several ERBS subsystems 17' depicted in FIG. 3 comprise the overall ERBS systems 17 installed under structure 10.

In the practice of this invention, the piers already existing under the housing units usually are retained, although some of them may need to be moved to provide room along the beams to accommodate the ERBS systems components. The ERBS subsystems provide sufficient vertical support for the housing units that their presence permits corresponding piers, pre-existing at the locations of the bracing subsystems, to be removed.

Figure 6:
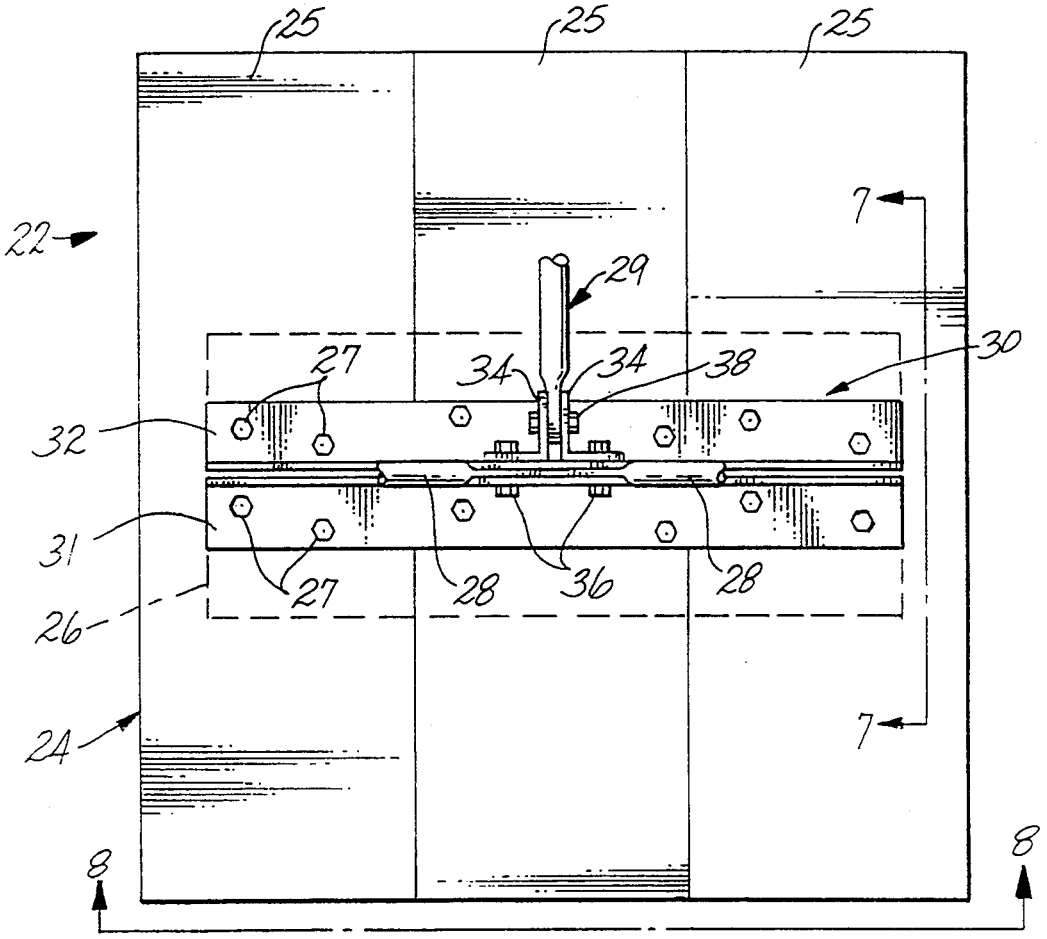
FIG. 6 is a plan view, with parts broken away, of a foundation pad for the present bracing system showing the connection of a pair of longitudinal braces and of a transverse brace assembly to the pad.
Figure 8:
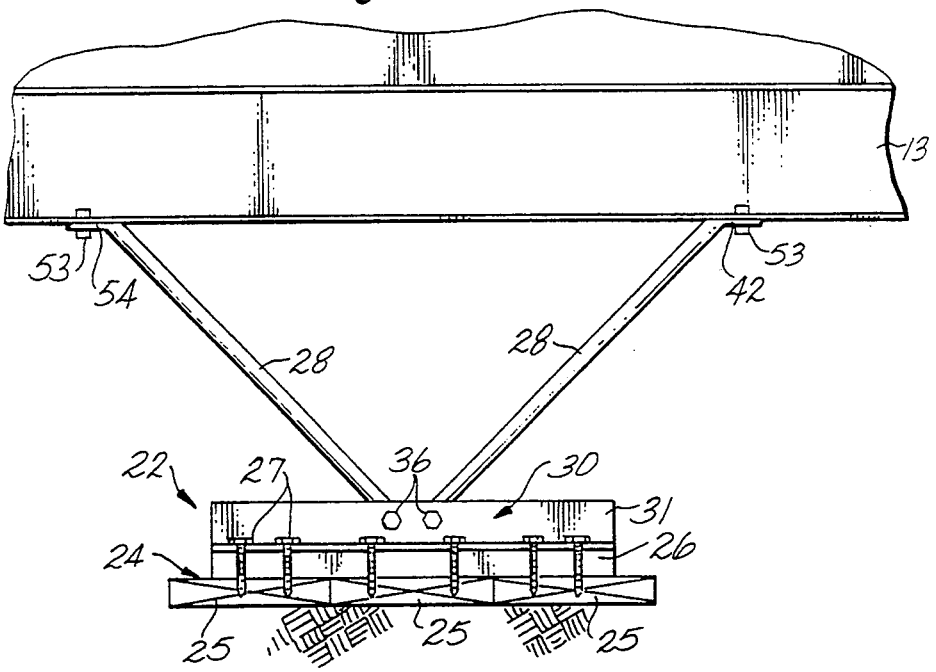
FIG. 8 is an elevation view taken along lines 8—8 of FIGS. 3 and 6.
Figure 9:
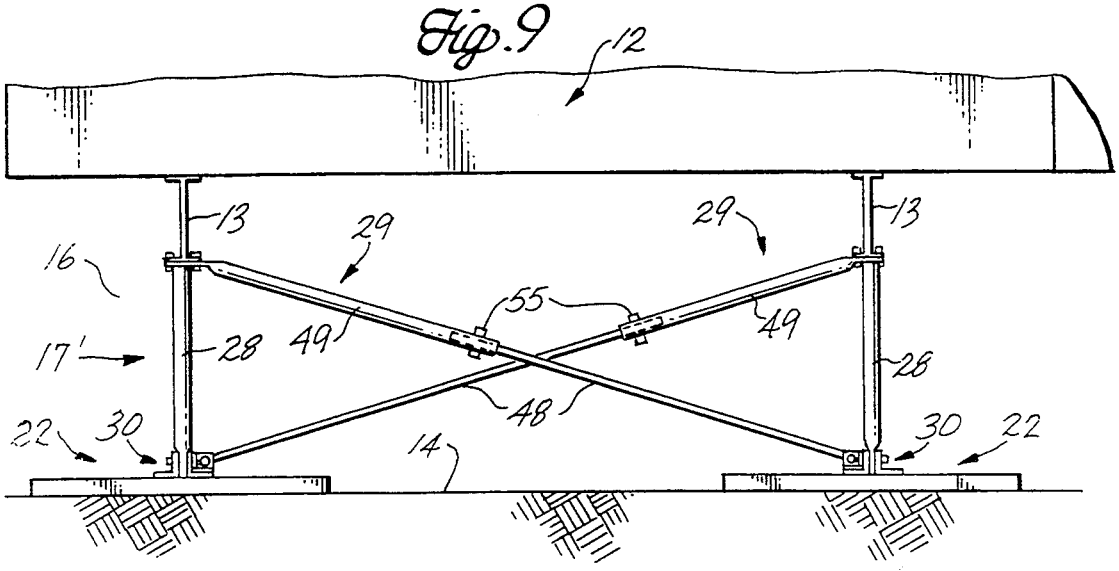
FIG. 9 is an elevation view taken along line 9—9 of FIG. 3.

As shown for example in FIGS. 6, 8, and 9, each ERBS subsystem 17' includes a pair of foundation pads 22, the specific details of which can be varied depending upon the local height of crawl space 16. Each foundation pad has a ground-engaging base 24 defined by three 2"×12"×36" lengths 25 of wood plank which have been pressure treated consistent with process specification #2 D.F.- L. to render them rot, insect and vermin resistant. If the crawl space height is in the range of from 20" to 27½ maximum, it is preferred that each foundation pad 22 include a height-increasing cross pad member 26 which preferably is a 30" length of pressure treated 2"×12" timber disposed crosswise of base members 25 centrally of their midlengths as shown in FIG. 6. The cross pad member 26, if provided, can be nailed to pad base numbers 25 by use of galvanized nails, for example; more usually, the cross pad 26 is secured to base elements 25 by screws 27 which are used to secure components of a brace connector assembly 30 to pad base 24. Cross pad 26, if present, is a component of pad base 24. All wooden components of ERBS systems 17 are pressure treated to the standards described above. The floor joists and floor rim members (which function as joists) in the housing unit substructures can be similarly pressure treated.

As shown in FIGS. 6–9, there are associated with each foundation pad 22 a pair of tubular steel longitudinal braces 28 (see FIGS. 4 and 5) and one adjustable-length transverse brace assembly 29 (see FIG. 9). The longitudinal braces and the transverse brace assembly are connected at their lower ends to the foundation pad. The longitudinal braces, which are of fixed lengths, slope upwardly and away from the pad into connection with the housing unit chassis beam 13 which lies directly above the foundation pad. The transverse brace assembly slopes upwardly away from the pad to the adjacent chassis beam of that housing unit. The connections of the lower ends of system components 28 and 29 to the respective foundation pad 22 are accomplished via a brace connector assembly 30 which is shown best in FIGS. 6 and 7.

The components of brace connector assembly 30 are a pair of horizontal, relatively longer, heavy steel angles 31 and 32 and a pair of vertical, substantially shorter lengths 34 of steel angle. Angles 34 are mounted to angle 32, in the manner described below, by machine nut and bolt sets 36 which define pin connections of the lower ends of respective longitudinal braces 28 to the foundation pad, as shown in FIG. 6. Angles 34 define connection brackets for the related transverse brace and are disposed in spaced back-to-back relation to each other. Angles 34 are mounted to the inner (toward the housing unit center line) vertical face of angle 32 which is mounted in back-to-back spaced parallel relation to angle 31 below and parallel to the chassis beam with which that base connector 30 is associated. A machine bolt 38 is passed through the parallel legs of angles 34 and through the lower end of transverse brace assembly 29 which is disposed between those legs, thereby to define a pin connection of the transverse brace assembly to the foundation pad. A nut is used to secure bolt 38 in place in brace connector 30.

Angles 31 and 32 preferably are 30" lengths of 3×3×¼ inch rolled steel angle bar. Angles 34 preferably are 2½ inch lengths of the same size steel angle bar as is used to define angles 31 and 32. Angles 31 and 32 are secured to pad base members 25, or to cross pad member 26 if it is present (compare FIGS. 6 and 7) and to members 25, by a plurality (preferably 6) of wood screws 27 which preferably are #10 hexhead galvanized wood screws.

Figure 5:
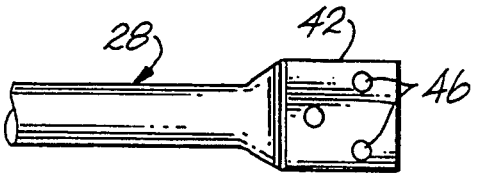
FIG. 5 is a view taken along line 5—5 of FIG. 4.
Figure 4:
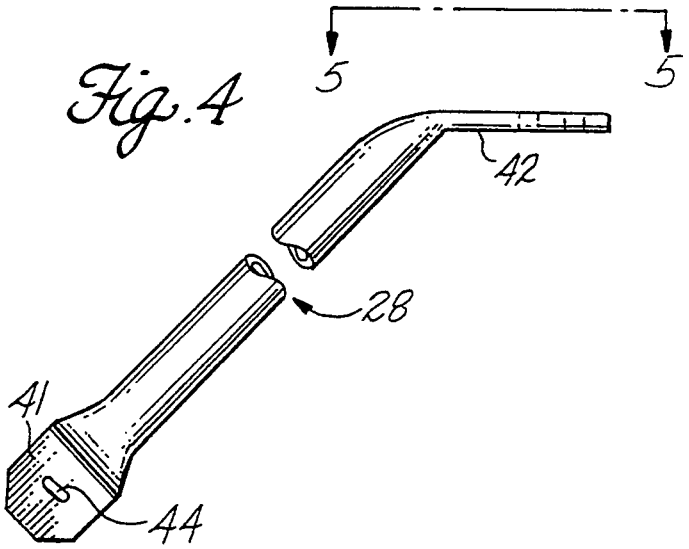
FIG. 4 is a fragmentary elevation view of a fixed length tubular longitudinal brace, a plurality of which are components of the bracing system.

FIGS. 4 and 5 show a longitudinal brace 28 according to this invention, four of which are components of each ERBS subsystem 17'. Each longitudinal brace preferably is fabricated from a length of 1½ diameter standard gage steel pipe which has been flattened, as by a press, at each of its ends to define a respective plate-like connecting tab 41, 42. Tab 41 is defined at the lower end of the brace and tab 42 is defined at the brace upper end. Tab 41 lies in a plane which preferably includes the center line of the pipe from which the brace is fabricated, whereas upper tab 42 does not, as shown in FIG. 4. Upper tab 42 lies in a plane which oblique to the plane of tab 41 and which is oblique to the length of the brace by an angle of deviation of about 45° in the "as manufactured" form of the longitudinal brace. Each longitudinal brace preferably has a maximum length of about 48" as measured from slot 44 along the axis of the brace to the plane of upper connecting tab 42.

Figure 7:
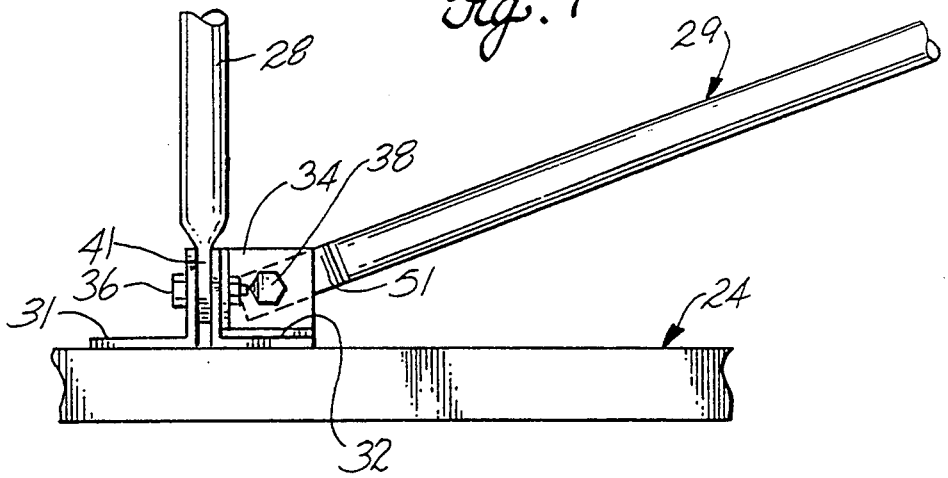
FIG. 7 is an elevation view taken along line 7—7 of FIG. 6.

A slot 44 is formed through the central portion of longitudinal brace lower end tab 41 and has its length aligned normal to the elongate extent of the brace. The preferred dimensions of the slot are 9/16"×1". If desired, however, a 9/16" diameter hole can be provided in lieu of slot 44. The corners of end tab 41 are chamfered as shown in FIG. 7. A pattern of bolting holes 46 is formed through the upper end tab 42 of brace 28 as shown in FIG. 5. The preferred pattern of holes 46 is a three hole triangular pattern which is disposed symmetrically in the pad relative to the length of the brace; holes 46 preferably have a diameter of 9/16", i.e., 1/16" oversize relative to the bolts which will pass through them in the assembly of the brace into ERBS subsystem 17'.

As shown best in FIG. 9, a transverse brace assembly 29 has two principal components. They are a relatively longer, relatively smaller diameter tubular steel lower member 48 and a relatively shorter, relatively larger diameter tubular steel upper member 49. The lower member preferably is fabricated of 1¼" diameter standard gage steel pipe, and the upper member preferably is fabricated of 2.0" diameter 10 gage steel tube. The lengths of the upper and lower members of transverse brace assembly 29 are selected so that they are engaged in telescoping overlapping engagement (with the upper end of the lower member inside the lower end of the upper member), with the minimum length of overlap being at least 6" for the longest possible installed length of the transverse brace assembly.

A shown in FIG. 8, the lower end of the lower member of transverse brace assembly 29 is flattened to define a connecting tab 51. A preferably 9/16" diameter hole is formed through tab 51 which preferably lies in a plane which includes the axis of the pipe from which lower member 48 is fabricated. The upper end of the upper member 49 of the transverse brace assembly is similarly flattened to define a connection tab similar to tab 42 located at the upper end of each longitudinal brace and in which is formed at least one bolting hole, preferably 9/16" in diameter. The connection tab at the upper end of brace assembly member 49, as manufactured, preferably deviates from the axis of that member by about 15°.

Figure 25:
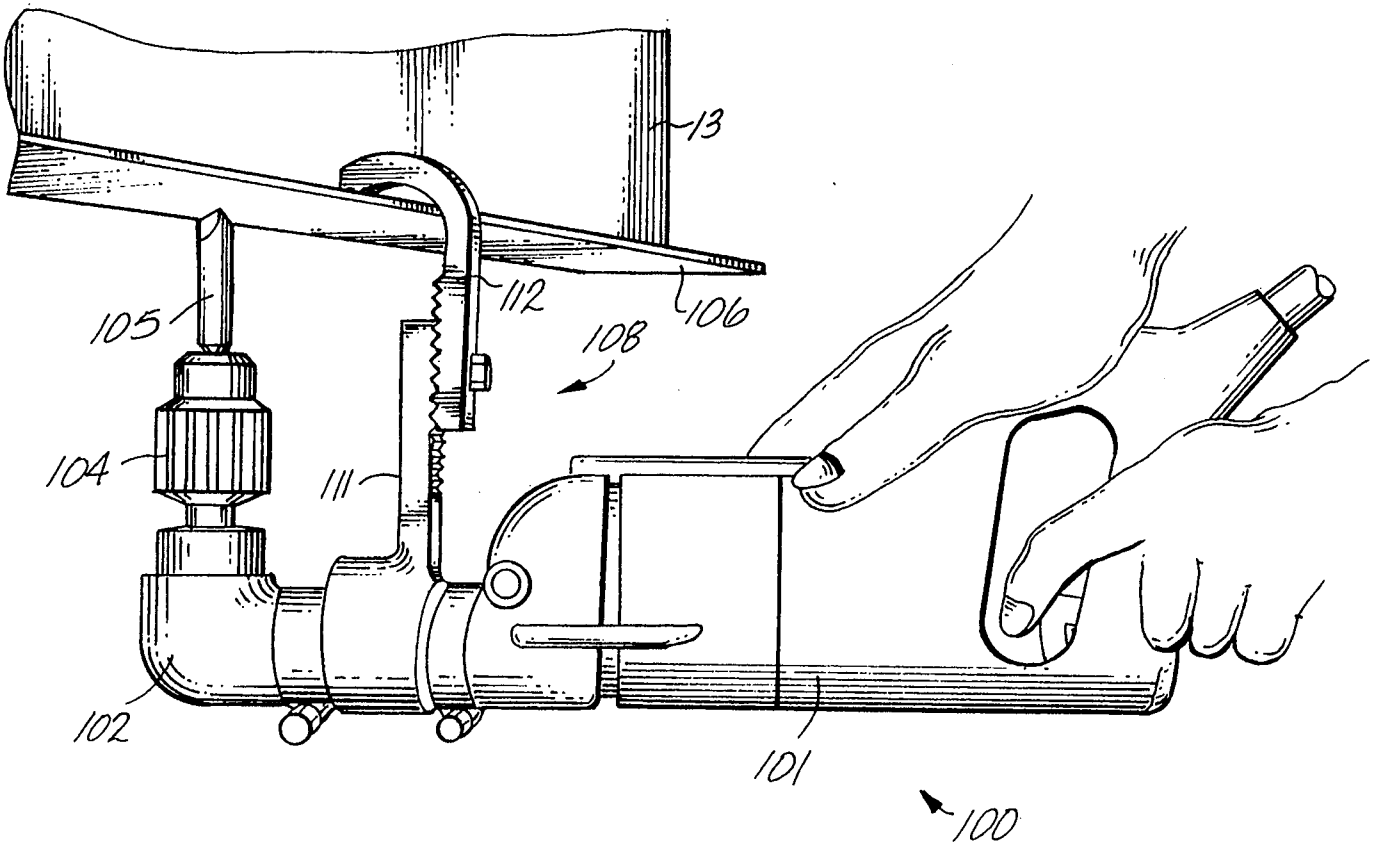
FIG. 25 is an elevation view showing an improved drilling tool useful to efficiently drill bolting holes in housing unit chassis beams from within the limited height crawl space afforded below a supported manufactured housing structure.
Figure 26:
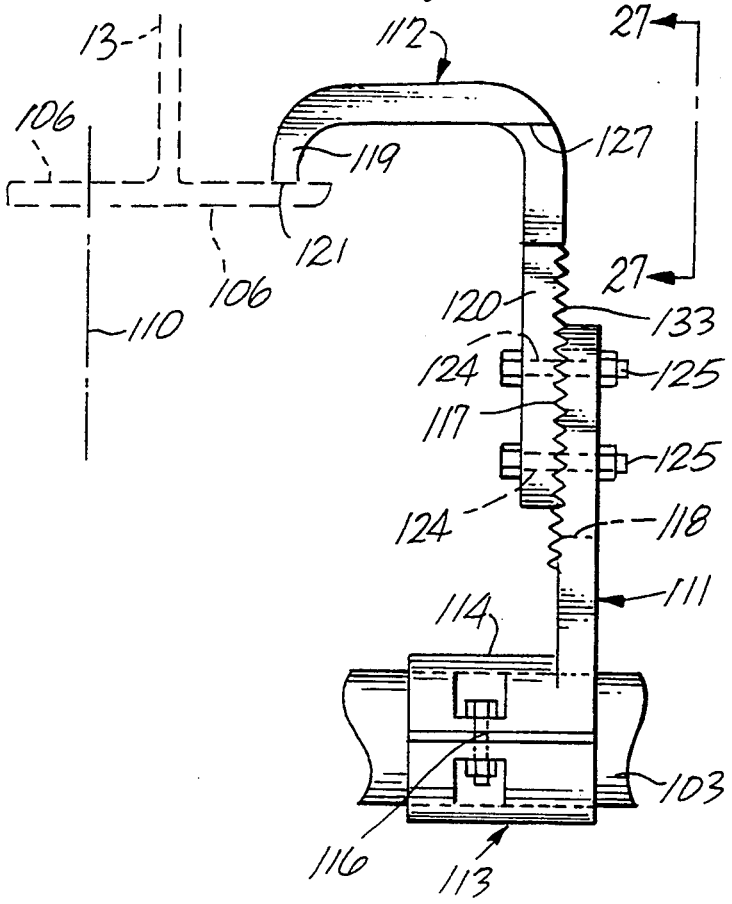
FIG. 26 is an elevation view of a component of the drilling too shown in FIG. 25.
Figure 27:
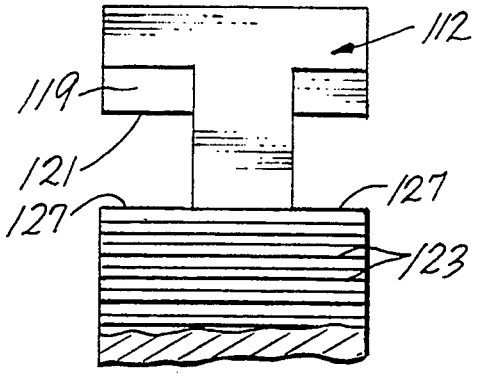
FIG. 27 is a fragmentary elevation view taken along line 27—27 of FIG. 26.

The structural features of an ERBS subsystem 17' as described above adapt those components to installation by an effective and efficient procedure which comprises the following principal steps: 1) establishing a foundation pad at grade at each of at least a pair of spaced locations below and along each housing unit chassis beam; 2) pinning to each foundation pad, at lower ends thereof, a pair of longitudinal braces which have predetermined length; 3) bolting the upper ends of the longitudinal braces to the corresponding chassis beam at locations spaced in opposite directions along the beam from the foundation pad below that beam; 4) pinning to each foundation pad the lower end of the two-part telescopically length-adjustable transverse brace assembly associated with that pad; 5) bolting the upper end of each transverse brace assembly to the other chassis beam at a location which is substantially opposite the lower end of that transverse brace assembly; and 6) fixing each transverse brace against axial movement of its two telescopically engaged parts relative to each other after connection of the brace lower and upper ends, respectively, to the foundation pad and the other chassis beam. The installation process includes performing, at appropriate times, the additional step of adjusting the angle of deviation of the upper connection tabs of the braces, preferably at the site of installation, so that the tabs lie substantially parallel to the chassis beam undersides thereby to conform to the actual crawl space height as encountered at the various locations where the braces are to be connected to the housing unit chassis beams. A further step is drilling through the chassis beams, at locations determined by the adjusted positions of the brace upper end connecting tabs, the necessary holes to enable the brace upper ends to be bolted to the chassis beams by use of machine bolts which preferably are 1/16" undersize relative to the holes formed in the brace upper end tabs. The bolting holes can be drilled conveniently and efficiently by use of the low clearance drilling tool which is shown in FIGS. 25–27 and which is described below.

More specifically, the process of installing the components of an ERBS system in the crawl space beneath housing units 11 and 12 preferably commences with the assembly of the foundation pads 22. The pad base has either the multi-layer definition shown in FIG. 8 or the single layer definition shown in FIG. 7. The inner angle member 32 of each brace connector assembly is affixed to the pad base by screws 27, as described above. If a pad base 24 includes a cross pad member 26, screws 27 are sufficiently long to extend through member 26 and into members 25 (see FIG. 8) so that the base members and the brace connector assembly are securely interconnected. The remaining angles 31 and 34 of the brace connector are then loosely assembled against the inner angle using bolts 36 and 38. Bolts 36 pass through the connection tabs at the lower ends of respective longitudinal braces 28, which tabs are positioned between the vertical legs of angles 31 and 32. Connection tab 51 at the lower end of brace assembly 29 is disposed between the parallel legs of angles 34, and bolt 38 is engaged through those angle legs and connection tab 51. As so assembled, outer angle 31 is loose on the upper surface of the pad base.

The upper ends of the longitudinal braces are then mated to the underside of the chassis beam above the respective foundation pad. If necessary, the angle of deviation of one or both of the brace upper end connection tabs is adjusted to cause the upper surface of each tab 42 to lie substantially flat against the underside of the chassis beam. Suitable lengths of 2×4 or other available timber can be engaged between the longitudinal braces and grade to wedge the braces temporarily against the chassis beam. The lower end of the upper member of the transverse brace assembly is telescoped onto the upper end of the brace lower member and the brace upper end connection tab is suitably adjusted angularly relative to the length of its member so that the tab registers substantially flat against the lower surface of the other chassis beam at a location substantially opposite the foundation pad to which the lower end of that transverse brace is connected, the upper end of the transverse brace can be temporarily wedged against the bottom surface of the other beam at the position where the transverse brace is to be connected to the other beam. When the upper end of each brace is properly positioned against the under surface of the chassis beam to which it is to be connected. The locations of the centers of the bolting holes to be drilled in the adjacent chassis beam are defined. The bolting hole locations are defined as a site-defined function of the geometry of the ERBS components and the crawl space height at the pertinent location, i.e., in terms of the angle of slope of the respective brace from vertical or horizontal after the brace has been connected to its foundation pad. If desired, the temporary wedges holding a brace against the beam underside can be removed to enable drilling of the desired bolting holes through the chassis beam, or the bolting holes can be drilled in the beam using the brace tab holes as guides for the drilling of the beam bolting holes.

It is preferred that the upper ends of the longitudinal braces are secured by two bolts 53 to their chassis beam before the upper end of the associated transverse brace is preliminarily mated to the underside of the other chassis beam of that housing unit. It is also preferred that the bolts 36 at the bottom ends of the longitudinal braces at each connection pad are tightened before the upper end of the associated transverse brace is preliminarily mated to the other chassis beam. Once bolts 36 have been tightened as desired, outer angle 31 of the relevant brace connector 30 is secured to the foundation pad base by wood screws 27 of length comparable to the length of the screws used to connect inner angle 32 to the pad base. Thereafter, the preliminary placement of the upper end of the transverse brace against the underside of the other chassis beam is (are) made and the bolting hole(s) in the other beam are drilled. Bolt 38 at the lower end of the transverse beam preferably is tightened after the upper end of the transverse brace has been securely bolted to the underside of the other chassis beam. At that point, the actual installed length of the transverse brace is defined consistent with the dimensions of the actual installation situation existing at that site. A hole is then drilled diametrically through the transverse brace where the lower end of its upper member is engaged around the upper end of its lower member, and a nut and bolt 55 is assembled through that hole to permanently fix and establish the "as installed" length of the transverse brace. The bolts used in assembly of the ERBS Subsystems preferably are ½" diameter machine bolts conforming to ASTM grades A-325 or A-307, except that bolts 51 preferably are 3/8" in diameter.

The efficiencies of the structural and procedural aspects of the ERBS system described above are such that an experienced three man team can install the system under two 66 foot long manufactured housing units in four to five hours. That installation time is very short compared to the time required to install the known earthquake resisting bracing systems described above. Also, the costs of the components of ERBS system 71 are substantially less than the costs of the components of the known systems described above, due principally to the standardization of components of system 71 and their capability of being adjusted at the site to conform to the dimensional requirements of specific installation situations.

The angle of deviation of the longitudinal braces of system 71 from horizontal preferably is in the range of from 30° minimum to 60° maximum. The maximum angle of deviation of the "as installed" transverse braces 29 from horizontal preferably is about 20°.

Figure 10:
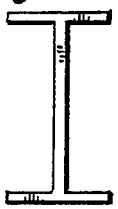
FIG. 10 is a cross-section view of an I beam which is the most commonly encountered form of chassis beam encountered in manufactured housing and mobil homes.
Figure 12:
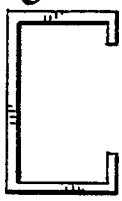
FIG. 12 is a cross-section view of yet another configuration of chassis beam which is even less commonly encountered in manufactured housing.
Figure 11:
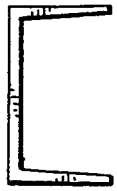
FIG. 11 is a cross-section view of another kind of chassis beam which is less commonly encountered.

FIGS. 10, 11 and 12 show the cross-sectional configurations of manufactured housing chassis beams which presently are encountered in the field. Approximately 80% of the situations encountered involve I beams having the general geometry shown in FIG. 10. Approximately 15% of existing manufactured housing units use chassis beams having the hot "C" simple channel configuration shown in FIG. 11. About 5% of existing manufactured housing units incorporate chassis beams having the cold "C" complex channel configuration shown in FIG. 12. The low clearance drilling tool shown in FIGS. 25–27 enables bolting holes to be drilled very conveniently in chassis beams having any of the configurations shown in FIGS. 10–12.

It is preferred that where the chassis beam is of the I beam configuration shown in FIG. 10, two bolting holes are drilled through the bottom flanges of the beam, one on each side of the beam web, to receive bolts 53 for longitudinal braces 28. Where the chassis beam has either the hot "C" configuration shown in FIG. 11 or the cold C configuration shown in FIG. 12 two longitudinal brace bolting holes are drilled in the bottom channel flange at locations corresponding to the central and inner (next to web) holes 46 defined in the upper end tabs of the longitudinal braces.

FIGS. 13–24 illustrate aspects of a second embodiment of this invention namely, a support and bracing system 60 for manufactured homes which qualifies as a permanent foundation under criteria established by the State of California and by the U.S. Department of Housing and Urban Affairs (HUD). Permanent foundation system 60 includes the above-described elements of an ERBS System according to this invention and additional elements and components, as described below, in cooperation with existing support piers 61. Except as noted, the foundation pad and brace components used in permanent foundation system 60 conform to the foregoing descriptions of system 17 and its subsystem 17'.

Figure 13:
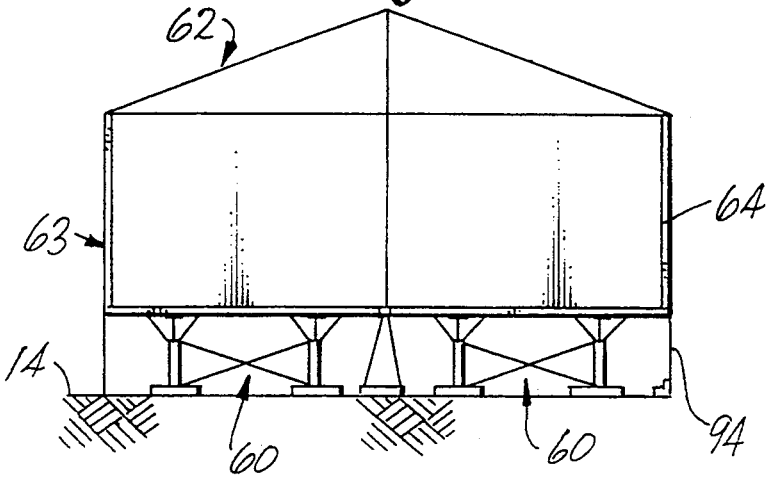
FIG. 13 is an end view, similar to FIG. 2, of a two-unit manufactured housing structure in the crawl space below which is installed a support and bracing system according to a second embodiment of this invention, which system qualifies as a permanent foundation for manufactured homes.
Figure 14:
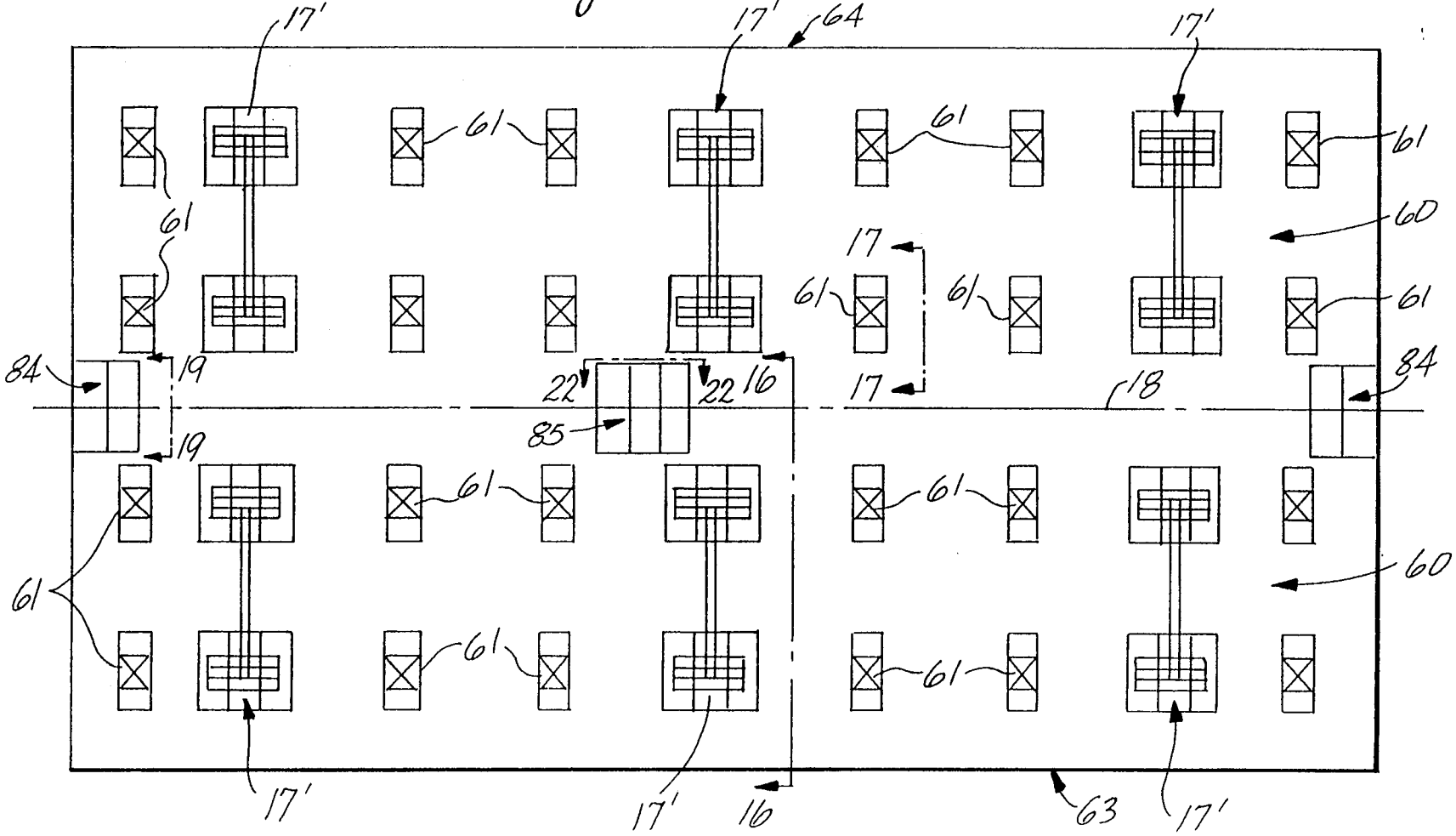
FIG. 14 is a plan view, similar to FIG. 3, which schematically shows the relation of the components of the permanent foundation bracing system relative to the manufactured housing units depicted in FIG. 13.

FIG. 13 shows a habitable structure 62 which is composed of two manufactured housing units 63 and 64 supported, as shown best in FIG. 14, by permanent foundation systems 60, by beam supporting piers 61 and by additional pier systems located along the mating line 18 between housing unit 63 and 64. Piers 61 are of the kind that are used to provide initial legally minimum support of the housing units consistent with the mode of construction of the housing unit and with the distribution of weights within them as described in the installation specifications provided by the manufacturer of the housing units. In the illustrative example shown in FIG. 14, housing units 63 and 64 are assumed to be 49 feet in length. When ERBS systems 17' are used as components of permanent foundation system 60, they are located as intervals not exceeding $16\frac{1}{2}$, along the length of the housing unit. Thus, more subsystems 17' typically will be used in a permanent foundation system 60 of a housing unit of given length than will be used in an earthquake bracing system 17 for a housing unit of the same length.

The maximum spacing between adjacent piers 61 along a chassis beam, or between a pier 61 and an adjacent ERBS subsystem 17', is 8'.

Figure 15:
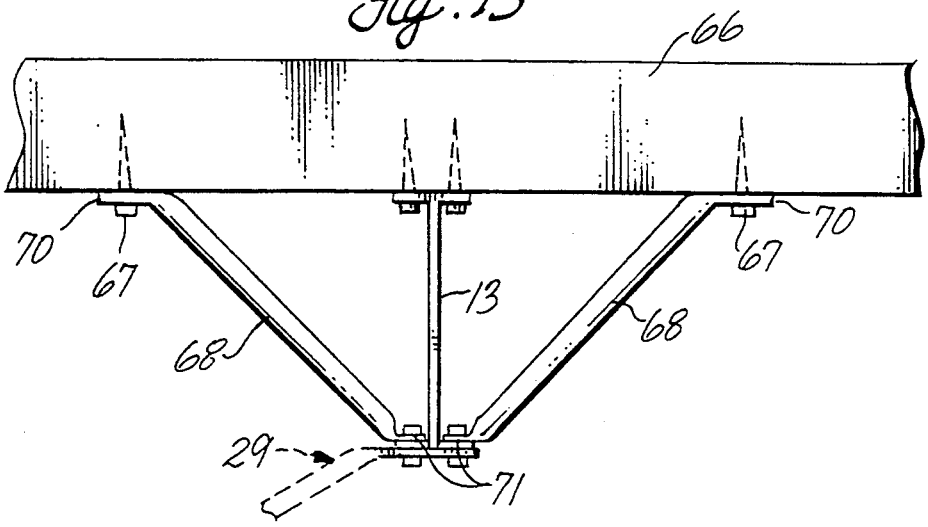
FIG. 15 is an enlarged fragmentary elevation view of bracing connected between housing unit floor joists and a chassis I beam to strengthen the beam against collapse when subjected to lateral loads of a shearing nature.

FIG. 15 shows a presently preferred arrangement for laterally bracing a chassis beam 13 preparatory to connection of the permanent foundation system to the beam. The beam is shown secured to the underside of a transverse floor joist 66 as by lag screws 67. A pair of beam braces 68, preferably fabricated of 1" diameter 12 gage steel tube, are engaged between the lower portion of the chassis beam on either side of the beam at their lower ends. The upper ends of the beam braces 68 are secured to floor joist 66 as by further lag screws 67 at locations spaced on opposite sides of the beam. The angle of inclination of the beam brace between the beam lower portion and the floor joist is approximately 45° and the maximum length of the brace between those locations is on the order of 17". The tubing at each end of the brace is flattened to define upper and lower connection tabs 70, 71 respectively. The lower ends of the beam braces are connected to the beam by 3/8" or $\frac{1}{2}$" diameter machine bolts. A pair of beam braces 68 is connected to each chassis beam within 6" of the location on the beam where a cross-brace of an ERBS subsystem 17' will be connected to the same beam.

After the chassis beams have been braced, as needed, in the manner shown in FIG. 15, the requisite number of ERBS subsystems 17' are installed between the beams and grade in the crawl space beneath each of housing units 63, 64. To accomplish the installation of the ERBS subsystems, it may be necessary to move or to remove certain of the piers 61 which are engaged between those same beams and grade under the housing units. FIG. 16 shows an ERBS subsystem 17' installed in the crawl space below housing unit 63 after bracing of that unit's chassis beams.

FIGS. 17 and 18 are elevation and top plan views of a pier 61 of the kind which is currently commonly used to support chassis beams of manufactured housing units. Such a pier preferably is used with a pad which typically is comprised of a single piece 75 of pressure treated 2"×12" timber approximately 30' in length. As described above, a pier has a square base 76 at the bottom of a four-sided pyramidal framework 77. The pyramid-shaped framework may or may not be truncated at its top, where it adjustably receives an externally threaded stud 78 which is secured to the central bottom portion of an upwardly open U-shaped bracket 79. Bracket 79 straddles the lower portion of a chassis beam in use of the pier. The elevation of the beam engaging bracket above the pier support pad 75 is adjusted at the site at needed to cause the pier to be firmly engaged between the beam and grade and to support the housing unit in a horizontal attitude.

Piers 61 are manufactured with different vertical load support ratings, namely, ratings of 2400 lbs., 3600 lbs., and 4800 lbs. As shown in FIG. 20, if a single pier rated at 3600 lbs. or 4800 lbs. is to be used in association with a housing unit chassis beam, the pier is supported on the upper surface of a 2×12×24 pressure treated wooden cross pad 81, which is disposed transversely of the mid-length of a pair of ground engaging pier pad members 75.

As shown in FIG. 14, permanent foundation systems 60 installed in the crawl space beneath mated housing units 63 and 64 include multi-pier supports 84 and 85 under the housing unit longitudinal wooden rim beams 87 which are nailed together on opposite sides of the mating line 18 between housing units 62 and 64. As shown in FIG. 21, a double-pier support assembly 84 comprises a pair of suitably rated piers 61 disposed on the upper surface of a 2×12×30 inch long wooden cross pad 82 disposed transversely of a set of three pier pad planks 75. FIG. 23 is top plan view of a triple pier firm support assembly 85 which includes three suitably rated piers 61 placed upon the upper surface of a 2×12×48 inch long cross pad 83 which is disposed transversely of a set of four pier pad planks 75.

The preferred manner of associating multi-pier supports 84 and 85 with the abutting floor rim beams 87 at the mating line between two manufactured housing units is shown in FIGS. 19 and 22 with reference to a triple pier support assembly 85. A suitable length, say 48", of 2"×4" timber 89 and a suitable length, say 36" of 4"×6" timber 90 are nailed together in the relation shown in FIG. 22. That construction is then nailed to the undersides of the abutted rim beams 87 of the mated housing units. A triple-pier support 85 is then assembled beneath, or is then placed preassembled beneath, timber 90 and the brackets 79 of the several piers are snugged into straddling engagement with and support of timber 90 and the load carried by it. If a triple-pier support 85 has a vertical load rating of 9600 lbs., it preferably is composed of a central pier rated at 4800 lbs. and two 2400 lbs. rated piers. After proper placement and engagement of a multi-pier support assembly with the structure to be supported, nails are driven through the vertical legs of the pier brackets 79 (see FIG.19) to firmly couple the support to the housing unit substructure via the intermediate timbers 89 and 90.

A two-pier support 84 can be defined of two 2400 lbs. or two 3600 lbs. piers to provide a support rated at 4800 lbs. or 7200 lbs. In engaging a two-pier support to the adjacent rim beams of mated manufacturing housing units, the timbers corresponding to timbers 89 and 90 in FIG. 22 can have lengths of 24" and 18", respectively.

Conditions may be encountered where it is desirable to use a single pier support at the mating line between two housing units. FIG. 24 shows how a single pier, rated at 2400, 3600 or 4800 lbs., preferably is engaged with the mating rim beams in such an instance.

Following installation of permanent foundation systems 60 below structure 62, the crawl spaces below that structure may be enclosed by a skirt 94. If so, ventilation openings (not shown) are provided in the skirt. There is one square foot of ventilation opening for each 150 square foot of crawl space floor area. It is preferred that the ventilation openings be located close to the corners of structure 62 to provide cross-ventilation of the crawl space. The ventilation openings are protected with ¼ corrosion resistant wire mesh.

FIGS. 25, 26 and 27 illustrate a drill assembly 100 which was been developed for use in low clearance environments, such as a crawl space 16, to readily and efficiently drill in the bottom flanges of manufactured housing unit chassis beams the holes required for connection of the longitudinal and transverse braces of an ERBS subsystem 17' to the beams. The drill is composed of a heavy duty, preferably electrically powered drill 101 of the type which is typically used by plumbers and which has a right angle drive 102 carried at one end of a cylindrical housing 103 (See FIG. 26) of a drill shaft extension assembly, the other end of which is connected to drill 101. A chuck 104 is carried by the output shaft of the right angle drive for receiving a drill bit 105 which preferably is a unfluted drill bit of the appropriate diameter for drilling the desired holes in the bottom flanges 106 of a housing unit chassis beam 13 which, in the instance shown in FIG. 25, is of I beam configuration. An adjustable fulcrum assembly 108, shown in detail in FIGS. 26 and 27, is clamped around drill shaft extension housing 103 and is disposed substantially parallel to the axis of the output shaft of right angle drive 102. That axis is represented in FIG. 26 by line 110.

As shown in FIG. 26, fulcrum assembly 108 is composed principally of an arm member 111, a hook member 112 of substantially "J" configuration in elevation, and a clamp member 113. The clamp member is semi-circular to define one half of a circularly cylindrical sleeve, the other half of which is defined by a cooperating semi-circular clamp portion 114 at one end of arm member 111. The opposing semi-circular cylindrical surfaces of clamp member 113 and of arm clamp portion 114 have the same radius of curvature as the outer surface of shaft extension housing 103. Clamp member 113 and clamp portion 114 are engaged in secure clamping relation to the exterior of shaft extension housing 103 by a pair of bolts 116, one of which is shown in FIG. 26. The head of the bolt, and the nut which cooperates with the bolt, are disposed in suitable recesses formed in the exterior of the clamp member and the arm clamp portion. When arm 111 is clamped to drill 101, the elongate portion of arm member 111 lies normal to the drill shaft, i.e., parallel to the axis 110 of rotation of drill bit 105.

At its end opposite from clamp portion 114, the surface of arm 111 which faces toward the drill bit axis 110 is contoured to define a series of regularly spaced teeth 117 which extend across the width of that arm surface along lines which are perpendicular to the length of the arm. A slot aperture 118 is formed through the arm parallel to its length in that portion of its length which is covered by teeth 117.

The "J" shaped hook member 112 has a short leg 119 and a long leg 120. Short leg 119 has a tip 121. The outer surface of long leg 120 (the surface of the leg which faces away from short leg 119) is contoured to define a plurality of transverse teeth 123 which mate with the teeth 117 defined by arm member 111. A pair of holes 124 are drilled through the long leg in the area which defines teeth 123 so that, by use of suitably sized nut and bolt assemblies 125 cooperating in holes 124 and in slot 118, the toothed surfaces of arm member 111 and of hook member 112 can be securely clamped together in a desired adjusted position which locates hook tip 121 a desired distance from the axis of extension housing 103.

As shown best in FIG. 27, the sides of hook member long leg 120 are notched, as at 127, immediately adjacent the return bend portion of the hook member between legs 119 and 120. Notches 127 are so located in the hook member long leg that the tip 121 of short leg 119 is between the ends of the notches.

The spacing between hook member tip 121 and drill bit axis 110 is defined so that when the drilling tool is placed square relative to the web of an I beam chassis beam 13 which is to have a bolting hole drilled in its left lower flange (see FIG. 26), hook member tip 121 is engagable with the top surface of the right lower flange 106 of the beam about the same distance from the beam web as the spacing of the desired hole from the opposite side of the beam web. An upward force on drill bit 105 sufficient to produce efficient penetration of the drill bit through the beam flange is produced by either pushing down on or pulling down on the handle of drill 101 in the manner shown in FIG. 25. When the drill is so used, the short leg 119 of hook member 112 serves as a leverage fulcrum for the effective application of upward force to the drill bit against the beam flange.

When a mounting bolt hole is to be drilled in the right flange of beam 13 (see FIG. 26), drilling tool 100 is positioned so that the axis of extension housing 103 is skew to the length of the beam by an amount sufficient to enable the drill bit to be engaged with the underside of a beam right flange and the tip 121 of the fulcrum assembly to be engaged with the top surface of that same flange at an appropriate location displaced along the length of the flange from the desired position of the drill bit axis. Notches 127 in the base end of hook member long leg 120 afford clearance for the edge of the beam flange in that circumstance. Notches 127 are provided in the opposite edges of leg 120 so that the tool can be turned left or right from a square relation to the beam web.

In light of the foregoing descriptions, it will be appreciated that the height of the crawl spaces in which earthquake resistant bracing systems 17 or permanent foundation bracing systems 60 are to be installed are limited. Limited clearance drill 100 can be used very conveniently in such limited height spaces by a workman lying on his back pulling downwardly on the handle of drill body 101. While tool 100 need not be used to install the bracing systems of this invention in the crawl spaces below manufactured housing units, the use of that tool makes it possible to properly install those systems very efficiently.

Workers skilled in the art to which this invention pertains will appreciate that the foregoing descriptions have been presented with reference to presently preferred embodiments of the invention which have structural and procedural aspects. The preceding descriptions of those presently preferred embodiments of the invention are not intended to be, and are not to be read as an exhaustive catalog of all of the structural and procedural forms which may be used to practice this invention. Modifications and variations upon the structures and procedures described above can be used without departing from the fair inventive scope of this invention. Accordingly, the following claims are not to be interpreted as pertaining only to the structures and procedures which have been described above.

What is claimed:

1. A bracing system for mobil homes and manufactured housing units, each unit including a chassis comprised of a pair of spaced, parallel longitudinal metal structural beams, the bracing system comprising, for each said unit, at least a pair of foundation pads adapted for placement at grade at spaced locations along and below each unit chassis beam and, in combination with each foundation pad, a pair of tubular longitudinal braces of predetermined length adapted to be pinned to the foundation pad at lower ends thereof and to diverge upwardly in a first vertical plane in opposite directions to upper ends thereof which are adapted for bolted connections to a corresponding unit chassis beam, and a tubular transverse brace assembly adapted to be pinned at a lower end thereof to the foundation pad, to extend in a second vertical plane substantially normal to the first plane, and to be bolted at an upper end thereof directly to the other chassis beam, each transverse brace assembly comprising relatively larger and smaller tubular members telescopically engagable with each other centrally of the ends of the assembly and securable from axial relative motion via a pin connection defined to establish a distinctive site-determined as-installed length of the transverse brace assembly and in which pin connection all of a selected number of holes through each tubular member are aligned with corresponding holes through the other tubular member.

2. Apparatus according to claim 1 wherein the foundation pads associated with one chassis beam of the unit are disposed opposite corresponding pads associated with the other chassis beam of the unit.

3. Apparatus according to claim 1 including, at the upper end of each brace and brace assembly, a planar connection tab disposed obliquely to the length of the corresponding brace member, each tab defining through it at least one aperture.

4. Apparatus according to claim 3 including, at the lower end of each longitudinal brace, a planar connection tab which lies in a plane substantially parallel to the elongate extent of the brace and is oblique to the plane of the brace upper end tab, each brace lower end tab having an aperture through it.

5. Apparatus according to claim 4 wherein the brace lower end connection tab aperture is a slot aligned substantially perpendicular to the elongate extent of the brace.

6. A bracing system for a manufactured housing unit which unit includes a chassis comprised of a pair of spaced, parallel longitudinal metal structural beams, the bracing system comprising, at least a pair of foundation pads disposed below each unit chassis beam at grade and spaced a selected distance from each other along the length of the beam, and, in association with each foundation pad, a pair of tubular longitudinal braces of predetermined length and a transverse brace assembly, the longitudinal braces being pinned to the foundation pad at lower ends thereof and extending substantially in a first vertical plane in opposite lateral directions upwardly to bolted connections of upper ends thereof to the corresponding chassis beam, the transverse brace assembly being pinned at a lower end thereof to the foundation pad and extending from the pad substantially in a second vertical plane normal to the first plane to a bolted connection at an upper end thereof directly to the other chassis beam, each transverse brace assembly comprising a relatively larger and a relatively smaller tubular member telescopically engaged with each other centrally of the ends of the assembly and secured from axial relative motion via a pin connection defined to establish a distinctive site-determined as-installed length of the transverse brace and in which pin connection all of a selected number of holes through each of the larger and smaller tubular members are aligned with corresponding holes the other of the tubular members.

7. Apparatus according to claim 6 wherein the foundation pads associated with one chassis beam are disposed substantially in the second planes associated with the corresponding pads disposed below the other beam.

8. Apparatus according to claim 6 wherein the transverse brace assembly pin connection comprises a single pair of substantially diametrically opposed holes in each of the relatively larger and smaller tubular members.

9. Apparatus according to claim 6 wherein the chassis beams support a unit floor structure and including, proximate the connection of each transverse brace assembly to a beam, brace means connected to the beam at a lower extent thereof and to the floor structure at locations spaced on opposite sides of the beam of stiffening the beam against movement of its lower extent laterally of its upper extent.

10. Apparatus according to claim 6 wherein the unit is one of two cooperating units which are mated in edge-to-edge relation, each unit having thereunder said bracing system, and including support means engaged between grade and the mated unit edges at plural locations along the mated unit edges for supporting the units at their mated edges.

11. Apparatus according to claim 10 wherein at least one support means comprises at least a pair of piers.

12. Apparatus according to claim 6 including a plurality of piers engaged in beam supporting relation between each beam and grade at each of a corresponding plurality of locations which are spaced along each beam of each unit separately from the bracing systems connected to each beam.

13. A method of bracing against loss of support by earthquakes and other natural events a unit of manufactured housing which unit includes a pair of spaced parallel longitudinal chassis beams, the unit being supported above grade on a plurality of piers engaged with the beams to define a crawl space between the unit and grade, the method comprising the steps of a) establishing a foundation pad at grade at each of at least a pair of spaced locations below and along each chassis beam, b) pinning to each foundation pad at lower ends thereof a pair of tubular longitudinal braces of predetermined length, c) bolting upper ends of the longitudinal braces to the corresponding chassis beam at locations spaced in opposite directions from the foundation pad, d) pinning to each foundation pad the lower end of a two-part telescopically length-adjustable tubular transverse brace, e) bolting an upper end of each transverse brace directly to the other chassis beam at a location substantially opposite the lower end of that transverse brace, and f) after connection of the brace lower and upper ends respectively to the foundation pad and to the other beam, 1) drilling at least one hole through the two parts of a transverse brace in the portions of their lengths which are telescopically engaged, and 2) securing a pin in each such hole to secure the parts from axial relative motion in each of two opposite direction along the brace.

14. The method according to claim 13 including drilling all bolting holes in the chassis beams at locations determined from the locations of registry of the upper ends of the braces after connection of their lower ends to the respective foundation pads.

15. The method according to claim 13 wherein the establishing step includes establishing each foundation pad at a location below its associated chassis beam which is transversely opposite the location of a foundation pad below the other chassis beam.

* * * * *